United States Patent [19]

Townsend

[11] 4,158,575

[45] Jun. 19, 1979

[54] CLEANING AND DISINFECTING HARD SURFACES

[75] Inventor: Robert L. Townsend, Irvine, Calif.

[73] Assignee: Purex Corporation, Lakewood, Calif.

[21] Appl. No.: 786,352

[22] Filed: Apr. 11, 1977

[51] Int. Cl.[2] ..... B08B 5/04; B08B 7/04

[52] U.S. Cl. ..... 134/6; 134/10; 134/21; 134/34

[58] Field of Search ..... 134/6, 10, 21, 34; 15/321, 353, 401, 322; 195/127; 21/58

[56] References Cited

U.S. PATENT DOCUMENTS

| | | | |
|---|---|---|---|
| 965,315 | 7/1910 | Moorhead | 15/321 X |
| 1,016,435 | 2/1912 | Overholt | 15/321 X |
| 1,849,663 | 3/1932 | Finnell | 15/401 |
| 2,292,435 | 8/1942 | Crites | 15/321 |
| 2,768,101 | 10/1956 | Fairchild | 134/34 |
| 3,019,462 | 2/1962 | Nash et al. | 15/401 X |
| 3,713,987 | 1/1973 | Low | 195/127 |
| 3,812,552 | 5/1974 | Blackmon | 15/321 |
| 3,896,520 | 7/1975 | Williams | 15/353 X |
| 3,896,521 | 7/1975 | Parise | 15/321 |
| 3,909,197 | 9/1975 | Cremers | 15/321 X |
| 3,962,745 | 6/1976 | Collier | 15/322 |
| 3,992,747 | 11/1976 | Hufton | 15/321 |

FOREIGN PATENT DOCUMENTS

| | | | |
|---|---|---|---|
| 584806 | 10/1959 | Canada | 15/321 |
| 899574 | 5/1972 | Canada. | |
| 687545 | 2/1953 | United Kingdom. | |

*Primary Examiner*—Richard V. Fisher
*Attorney, Agent, or Firm*—William W. Haefliger

[57] ABSTRACT

Soils and bacteria are removed from a hard floor surface by providing two resiliently flexible, transversely parallel strips, applying suction to the space between the strips so that their lower edge portions engage the floor surface, bodily displacing the strips longitudinally back and forth, while applying disinfectant or cleaning liquid to the floor surface outside the space between the strips to wet that surface over which the strips are displaced and flex back and forth.

13 Claims, 12 Drawing Figures

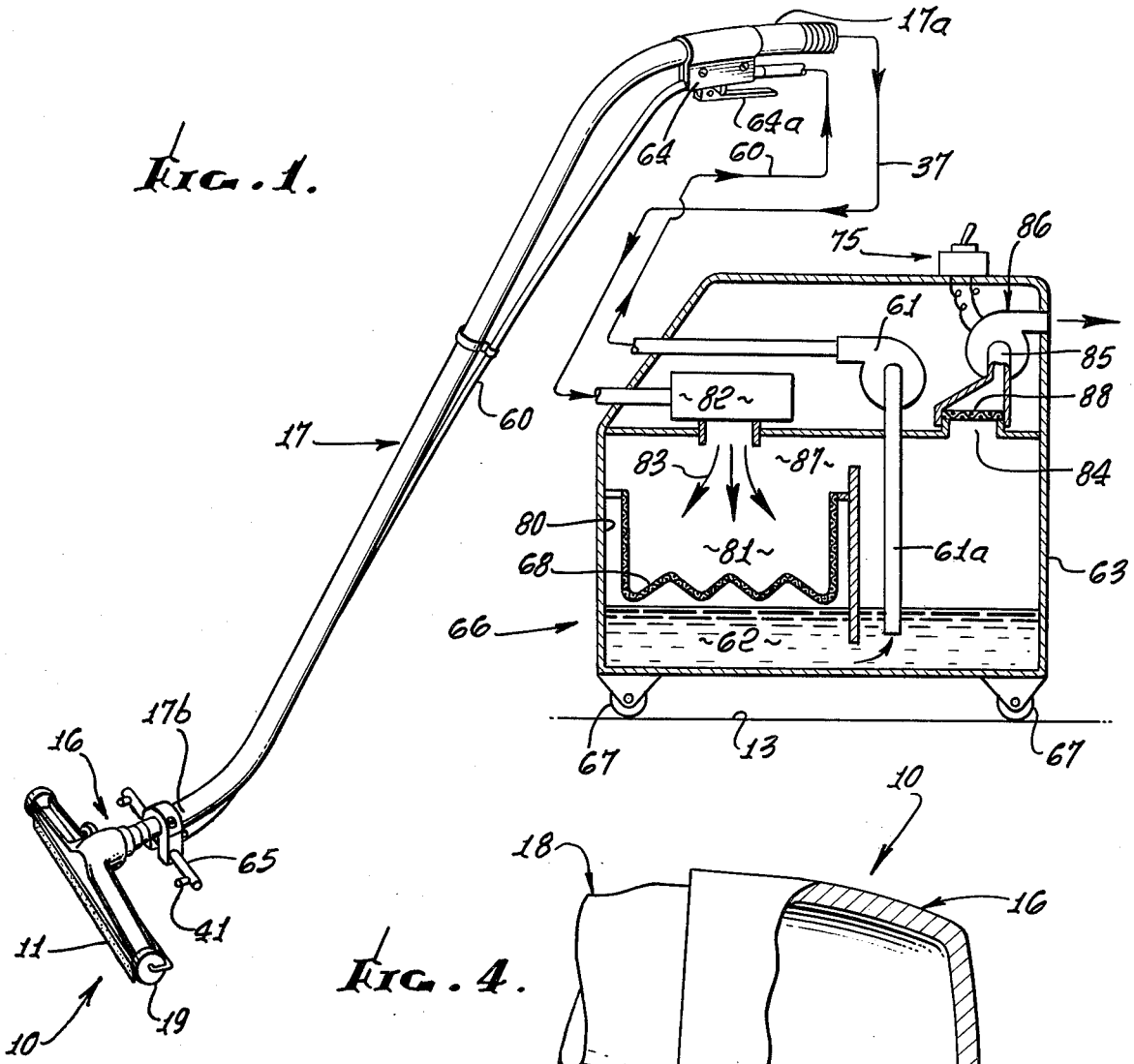
FIG. 1.
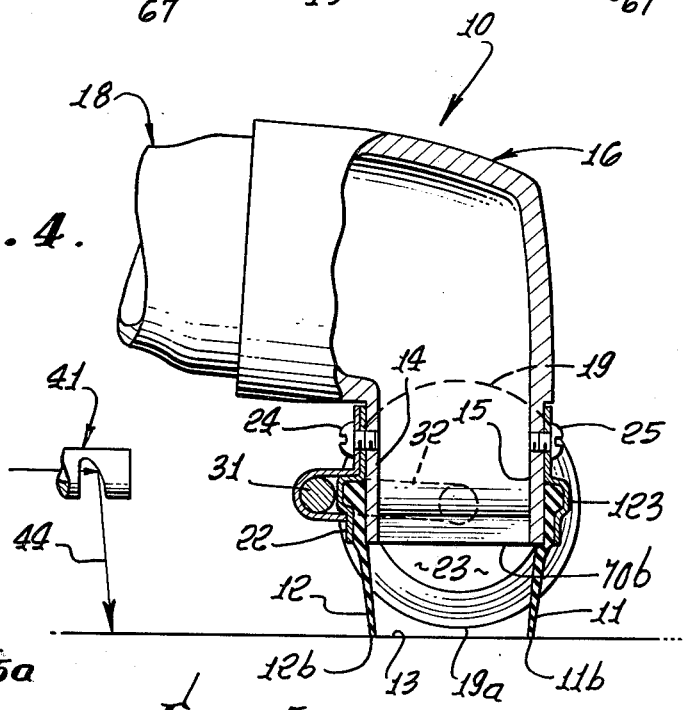
FIG. 4.
FIG. 5.
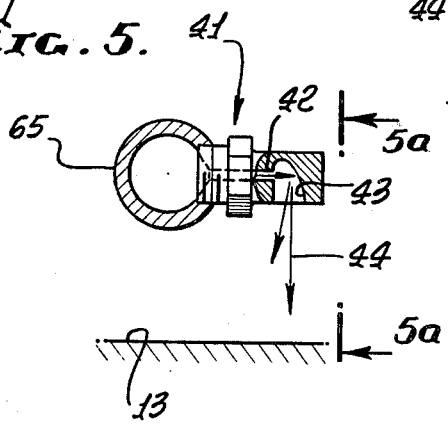
FIG. 5a.
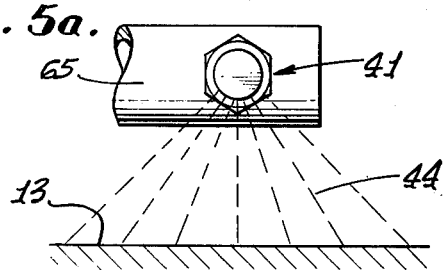

CLEANING AND DISINFECTING HARD SURFACES

BACKGROUND OF THE INVENTION

This invention relates generally to removal of soil and bacteria from hard surface floors; more particularly, it concerns method and apparatus to accomplish such removal, and employing both suction and spray producing means in a novel and highly effective manner.

In the past, primary reliance has been placed upon wet mopping to clean hard surfaced floors, as for example in hospitals, stores, and restaurants. Disadvantages with this well known procedure are numerous, and include the inability to remove the film of liquid left on the floor, whereby bacteria in such films are not removed; unsanitary conditions associated with wringing of the mop; and inability to reach floor corner areas. While various expedients have been proposed, none to my knowledge provide the unusually advantageous results and structural combinations of the present invention, which make use of the tool simple, effective and rapid, for cleaning hard surface floors. For example, Canadian Pat. No. 899,574 disclosed a vacuum cleaner floor tool operating to remove soils from surfaces such as carpets; however, no provision was there made for removal of bacteria and wet films on hard surfaced flooring, in the highly advantageous manner as now proposed.

SUMMARY OF THE INVENTION

It is a major object of the present invention to provide apparatus and method overcoming the deficiencies associated with prior hard floor surface cleaning methods. As will be seen, the invention has particularly advantageous use for cleaning hospital floors and corridors as well as other floor surface areas, and is characterized by elimination of need for mops, wet vacuums and floor scrubbers; it provides increased safety under foot and reduces maintenance work. In addition, it enables savings in water usage of up to 50%, as compared with the mop and bucket method.

Basically, the method of the invention comprises the steps that include:

(a) providing two upright, longitudinally spaced, resiliently flexible strips extending generally laterally horizontally and parallel, (b) applying suction to the space between the strips, (c) bodily displacing the strips longitudinally in one direction and in such proximity to the floor surface that the lower edge portions of the strips flex relatively in the opposite direction and the leading strip in said one direction passes loose soils relatively therebeneath into the space between the strips for suction removal from said space, (d) applying cleaning liquid to the floor surface to wet the surface, and (e) thereafter bodily displacing the strips longitudinally in the opposite direction and in such proximity to the wetted floor surface that the lower portions of the strips flex relatively in said one direction and the leading strip in said other direction passes said applied liquid relatively therebeneath into the space between the strips for suction removal from said space.

As will be seen, the liquid spraying step may include the use of a nozzle or nozzles to downwardly spray liquid such as germicidal solution in lateral fan shaped patterns at locations longitudinally spaced from the laterally extending strips, the nozzles being carried by the head assembly that includes the strips; the head assembly may be displaced back and forth to cause the flexible strips to scrub the wetted floor surface, prior to suction application to remove the liquid film or layer; a carrier may be provided to contain two tanks, one tank to receive soils, bacteria and liquid solution removed from the floor surface by suction, and germicidal solution in the other tank supplied to the nozzles for application to the floor surface. Accordingly, the source solution or liquid and picked-up solution are contained at all times and at one place, and handling of the solution including its replacement in the tank is simplified. Further, provision is made to control the level of support of the flexible strips to the end that their engagement with the floor surface and flexing may be adjusted to best cleaning effect.

In its broadest apparatus aspects, the invention comprises;

(a) a head assembly including two upright, longitudinally spaced, resiliently flexible strips extending generally laterally horizontally in parallel relation; the strips projecting downwardly to engage the floor surface, (b) means for applying suction to the space between the strips;

(c) the head assembly including support means to engage the floor while the head assembly is bodily displaced longitudinally in one direction with the strips in such proximity to the floor surface that their lower edge portions are flexed in the opposite direction, whereby the leading strip in said one direction passes loose soils relatively therebeneath into the space between the strips for suction removal from said space, and (d) means for applying cleaning liquid to the floor surface to wet that surface in such spaced relation to the strips that when the head assembly and strips are bodily displaced in the opposite longitudinal direction the lower portions of the strips flex relatively in said one direction and the leading strip in said opposite direction passes applied liquid relatively therebetween into the space between the strips for suction removal from said space.

These and other objects and advantages of the invention, as well as the details of an illustrative embodiment, will be more fully understood from the following description and drawings, in which

DRAWING DESCRIPTION

FIG. 1 is a perspective view of floor cleaning apparatus embodying the invention;

Figure 2:
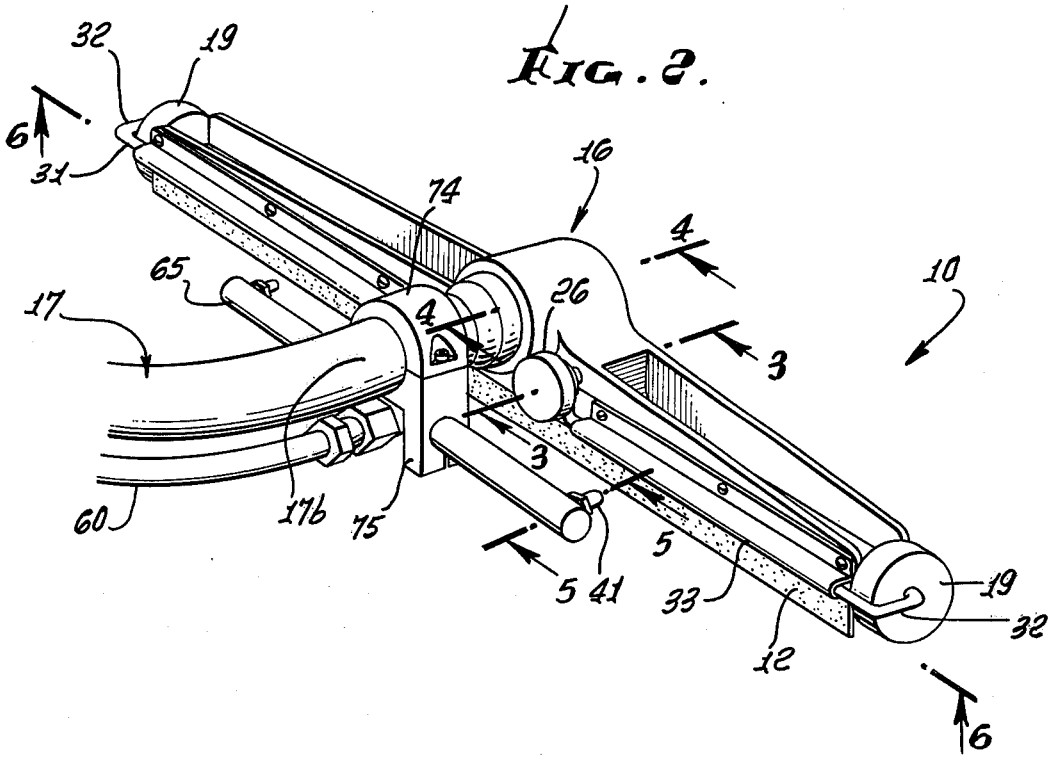
FIG. 2 is an enlarged perspective view of the floor cleaning head assembly.
Figure 3:
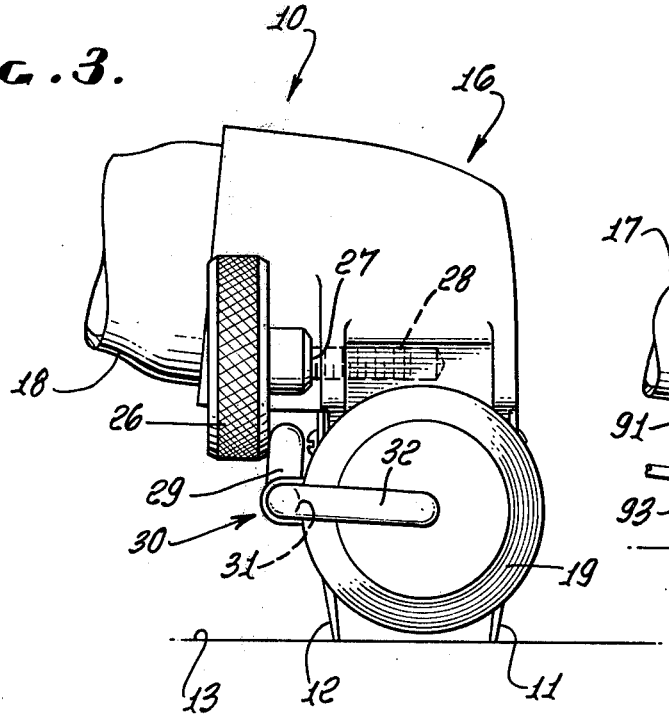
FIG. 3 is an enlarged elevational view taken on lines 3—3 of FIG. 2.
Figure 3A:
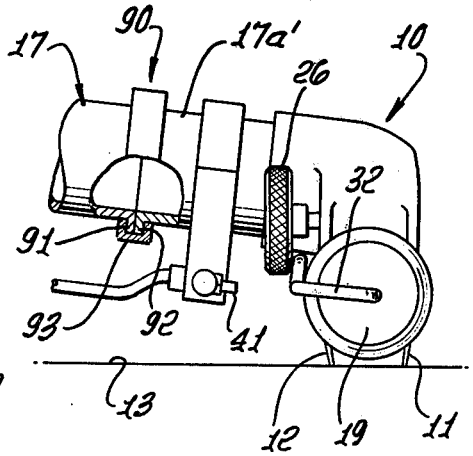
Figure 6:
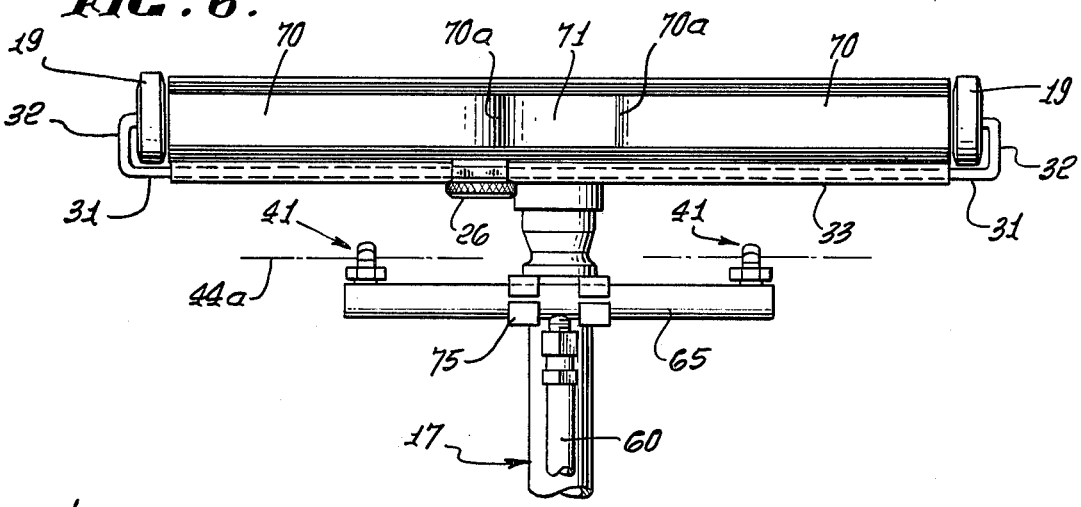
Figure 7:
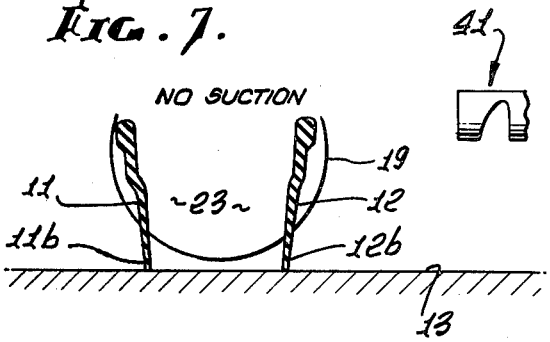
Figure 8:
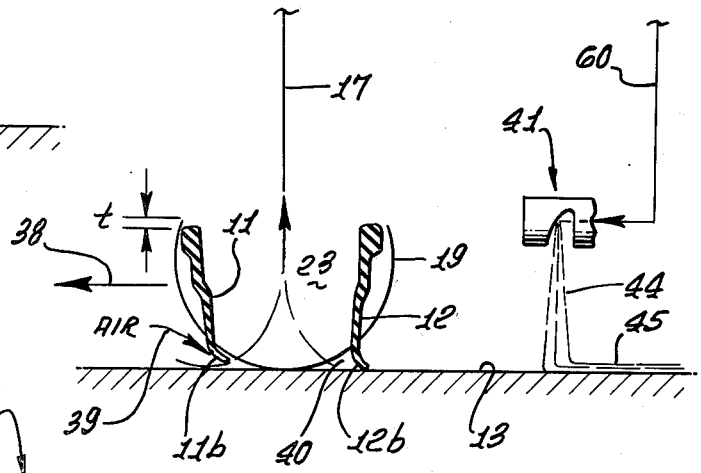
Figure 9:
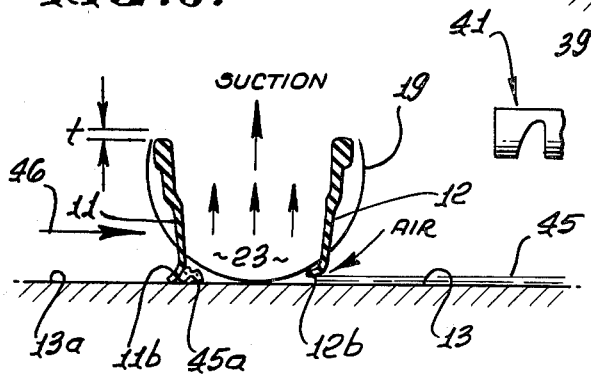
Figure 10:
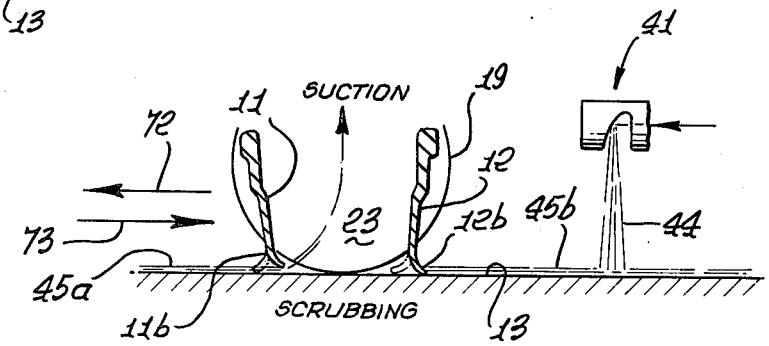

FIG. 3*a* is a view like FIG. 3, showing a modification;

FIG. 4 is an enlarged elevation view taken in section on lines 4—4 of FIG. 2;

FIG. 5 is an enlarged elevation view taken in section on lines 5—5 of FIG. 2;

FIG. 5*a* is an end view taken on line 5*a*—5*a* of FIG. 5;

FIG. 6 is a bottom plan view taken on lines 6—6 of FIG. 2;

FIG. 7 is a schematic showing of the head assembly flexible strips relative to a floor surface under conditions of no suction applied to the head assembly;

FIG. 8 is a schematic showing similar to FIG. 7, with suction applied and the head assembly moving in one direction;

FIG. 9 is a schematic showing similar to FIG. 7, with suction applied and the head assembly moving in the opposite direction; and FIG. 10 is a schematic showing similar to FIG. 7, with suction applied and the head assembly moved back and forth in scrubbing mode.

DETAILED DESCRIPTION

In the drawings, a head assembly 10 is shown to include two longitudinally spaced, resiliently flexible strips 11 and 12 extending generally horizontally in parallel relation. The strips are shown in FIG. 4 as projecting downwardly to engage the floor surface 13 at 11*b* and 12*b*, and they may consist of rubber or other elastomeric material. The head assembly may also include laterally elongated, downwardly opening structure as defined by walls 14 and 15 and a hollow gooseneck 16 intermediate the laterally opposite ends of the head assembly. An elongated, tubular handle 17 is connected at 18 to the gooseneck, and has S-shape, the upper extent 17*a* of the handle adapted to be manually grasped to manipulate the head assembly. The head assembly also includes support means, such as wheels 19 at laterally opposite ends of the walls 14 and 15, and closing the open ended chamber defined by such walls. Strips 11 and 12 are sealingly connected to the walls 14 and 15, as via clamp brackets 22 and 123, and fasteners 24 and 25.

It will be noted that the strips 11 and 12 project downwardly in FIGS. 4 and 7 beneath the bottom levels 19*a* of the wheels, whereby in the absence of suction application to the interior 23 of the chamber formed by the head assembly, the strips engage the floor. If the strips are quite flexible, they may bend under the weight of the head assembly, so that the wheels do engage the floor; however, the wheels do not project beneath the bottom levels of the strips to prevent their flexing engagement with the floor. For this purpose, the relative levels of the wheels may be upwardly adjusted, as by a nut 26 seen in FIG. 3. The nut is integral with a stem 27 which has threaded engagement at 28 with a bore in the head assembly, whereby the nut moves forwardly or reversely as it is turned. The lower portion of the nut bears against upper leg 29 of a bell crank 30, the latter including a laterally elongated pivot rod 31 and laterally spaced arms 32 which support the wheel axles. Accordingly, as the nut is advanced, the wheels are lowered, and vice versa. Rod 31 is loosely rotatably positioned by a guide sheath 33 attached to the head assembly. Adjustment of the wheels may thus be effected as related to the stiffness of the strips and as related to best cleaning effect, as will be seen.

Suction may be applied to the space 23 between the strips 11 and 12, as for example by a blower 86 having its inlet side connected with space 23 via duct 37 and hollow handle 17. See FIG. 8 in this regard. Suction causes the lowermost portions 11*b* and 12*b* of the strips 11 and 12 to flex, as the head assembly is displaced downwardly by amount "t" causing wheels 19 to rest on the floor surface. As the head assembly is then moved forwardly in one direction, as for example in the leftward direction of arrow 38, the strip lowermost portions 11*b* and 12*b* are flexed in the opposite, i.e. rightward direction. The leading strip 11*b* in that direction thus passes loose soils and bacteria relatively therebeneath into the space 23 between the strips, for suction removal. Note arrow 39 indicating air-flow beneath the lowermost portion 11*b* of the strip 11; also, note the lowermost portion of strip 12*b* scraping the floor surface and preventing air-flow from passing beneath it, into space 23. Some air may also enter space 23 via the small gaps 40 adjacent the wheels.

Means is also provided for applying cleaning liquid, as for example germicidal solution, to the floor surface to wet that surface in such spaced relation to the strips that when the head assembly and strips are bodily displaced in the opposite (rightward) longitudinal direction, the lower portions of the strips flex relatively in the one (leftward) direction; also, the leading strip 12*b* in that opposite direction then passes the applied liquid relatively beneath the strip and into the space 23 for suction removal. Such liquid application means may, with unusual advantage, include at least one spray nozzle, and preferably two nozzles 41 connected to the head assembly and directed to spray liquid downwardly onto surface 13 in spaced relation to the strips 11 and 12.

The illustrated nozzles 41 each include a spray orifice 42 (see FIG. 5) directed longitudinally, and a deflection surface 43 facing the orifice to receive impingement of liquid and to deflect same in a fan-shaped spray pattern 44 seen in FIG. 5*a*. Surface 43 curves downwardly and laterally to cause the spray fan to flare downwardly and laterally, to extents as also shown by broken lines 44*a* in FIG. 6. Accordingly, the liquid droplets cling to the floor surface and do not appreciably spatter or splash, as is also shown from FIG. 8. Typically, the liquid is delivered to the nozzles as the head assembly moves leftwardly as seen in FIG. 8, leaving a wet swath 45 covering the floor to the right of the head. FIG. 9 shows the head assembly subsequently moving rightwardly in the direction of arrow 46, the liquid 45 relatively entering the space between the strips 11 and 12 via the gap beneath upwardly flexed lowermost portion 12*b*, and being sucked upwardly. Lowermost portion 11*b* of strip 11 drags on the floor surface 13 to block escape of any remanent liquid, whereby the latter 45*a* at the rightward edge of strip portion 11*b* may be sucked up as it accumulates. The floor surface 13*a* at the left of strip 11 is thereby left clean and substantially dry; also it is disinfected if germicidal solution has been used. From what has been said, and from the drawings, it is clear that the liquid is applied to the floor surface outside the space between the strips to wet the surface. Such application involves visibly and openly downwardly spraying the liquid in a fan shaped spray. Also, the two flexible strips are allowed to pivot independently during their bodily displacement over the floor surface.

Referring to FIGS. 1 and 8, germicidal solution may be delivered to the nozzle via a flexible duct or line 60 and pump 61, the latter taking suction via inlet pipe 61*a* from a reservoir 62 of such liquid in tank 63. A control valve 64 in line 60 regulates the supply of solution to the nozzle. The two nozzles 41 may be supported by a nozzle carrier 65 to which duct 60 is centrally connected, as seen in FIG. 6. The illustrated tubular carrier or manifold extends transversely and is connected to that portion 17*b* of the handle or wand 17 proximate the head assembly. Valve 64 may be located at the upper end portion 17*a* of the S-shaped handle, and may include a lever 64*a* adapted to be finger actuated, as viewed in FIG. 1.

Tank 63 is shown as mounted on an ambulatory carrier 66, which has wheels 67 to allow the carrier to be pulled about wherever the apparatus is to be used. A receiver tank on or in the carrier may be formed as by a flaccid bag 68 located within a well 80 on the carrier. The interior 81 of the bag receives discharge 83 from the handle 17 via line 37 and a separator 82. Such discharge may include dry bacteria and soils picked up off a dry hard surface floor, or bacteria in germicidal solution picked up off the floor. The discharged germicidal solution is retained in the bag 68 and it also receives dry bacteria discharge downwardly at 83, to kill same. Dry bacteria that is not trapped in the solution may be sucked toward outlet 84, which is in communication with the suction or inlet side 85 of blower 86. The latter operates continuously and produces suction communication to the head assembly 10, via the enclosed interior 87 of the carrier, separator 82, line 37, and handle 17. See also U.S. Pat. No. 3,896,520 in this regard.

A sub-micron filter 88 is typically located at or near the inlet to blower 86 to trap airborne bacteria, preventing exhausting thereof to the atmosphere.

Referring to FIG. 10, it shows the head assembly including strips 11 and 12 and wheels 19 being moved back and forth, as indicated by arrows 72 and 73, so that the back and forth flexing lowermost portions **11*b* and 12*b* of the strips scrub the floor surface 13 wetted by spray from the nozzles. The film of liquid is shown at 45*a* and 45*b* at opposite sides of the strips as a result of no suction application during scrubbing. Thereafter, suction may be applied to space 23 to cause pick-up of the liquid film. A suction ON-OFF control 75 may be located at the tank, in association with blower 86. Also, the blower 86 and pump 61 may be integral with or carried by the carrier 66**.

FIG. 6 shows bottom walls 70 of the head extending transversely and leading into the gooseneck opening 71 at location **70*a*. Walls 70 are at the level indicated at 70*b* in FIG. 4**.

The nozzles 41 have lateral side openings, as seen in FIGS. 7–10, to permit lateral fanning of the spray pattern. The nozzle carrier in FIG. 2 includes bracket elements 74 and 75 encompassing the lower end portion **17*b* of the handle, bracket portion 75 supporting ducts 65**.

In FIG. **3*a*, a swivel joint 90 is shown connected in the wand or handle 17 near the head assembly 10, enabling the operator to keep the head assembly 10 parallel to the floor surface while manipulating the handle to clean under furniture, cabinets, etc., with short legs. The joint 90 may be defined by adjacent flanges 91 and 92 on the end of handle 17 and the end of stub pipe 17'*a*, and a coupling sleeve 93** embracing the two flanges. Seals may be provided, if desired.

I claim:

1. In the method of removing soils and bacteria from a hard floor surface, the steps that include (a) providing two upright, longitudinally spaced, resiliently flexible strips extending generally laterally horizontally and parallel to one another, (b) applying suction to the space between the strips so that the lower edge portions engage the hard floor surface and flex, (c) bodily displacing the strips longitudinally in one direction in such proximity to the floor surface while continuing said suction application to an extent that the lower edge portions of the strips flex relatively in the opposite direction and the leading strip in said one direction passes soils relatively therebeneath into the space between the strips for suction removal from said space, (d) applying disinfectant liquid to the floor surface outside the space between the strips to wet the surface, and (e) bodily displacing the strips longitudinally in the opposite direction and in such proximity to the wetted floor surface and while further continuing said suction application to an extent that the lower portions of the strips flex relatively in said one direction and the leading strip in said opposite direction passes said applied liquid relatively therebeneath into the space between the strips for suction removal from said space.

2. The method of claim 1 wherein said application of said liquid includes the step of visibly and openly downwardly spraying the liquid from nozzle means in a fan shaped fine spray at a location longitudinally spaced from said strips, and bodily displacing said nozzle means with said strips.

3. The method of claim 2 wherein said spraying step includes simultaneously spraying two such fan shaped fine sprays in laterally spaced relation, each spray fan defining a lateral upright plane.

4. The method of claim 1 including the step of repeatedly bodily displacing the strips back and forth in said directions during said application of said liquid to the floor surface thereby to scrub said surfaces.

5. The method of claim 1 wherein said liquid comprises a germicidal solution.

6. The method of claim 5 that includes preliminarily providing a carrier and two tanks on the carrier, pouring germicidal solution into at least one of said tanks, delivering solution from one tank for application to the floor surface as aforesaid, and delivering the suction removed soils, floor applied solution and bacteria to the other tank for killing of remanant living bacteria in the solution in said other tank.

7. The method of claim 6 including the step of providing an elongated handle connected to said head, and a solution supply duct carried by the handle, and controlling the delivery of said liquid through said duct for application as aforesaid.

8. The method of claim 1 including providing a suction head that mounts said two strips, the head including floor engaging support means, providing an elongated handle connected to said head, adjusting the elevation of the suction head relative to said support means to locate the strips at an elevation relative to the floor surface to flex as aforesaid, and allowing the flexible strips to pivot independently during their bodily displacement as aforesaid.

9. The method of claim 8 wherein said floor engaging support means comprise wheels at laterally opposite ends of said head, and including the step of adjusting the levels of said wheels relative to said strips to cause said strips to project downwardly beneath the bottom levels of said wheels whereby when suction is applied to the space between the strips the lowermost portions of the strips will flex in response to suction produced downward force transmission to the strips.

10. The method of claim 1 wherein said suction application causes entrainment of soils and bacteria in a stream of suction air, and including the step of filtering said air stream to remove bacteria therefrom prior to exhausting the air to the atmosphere.

11. In the method of removing soils and bacteria from a relatively smooth floor surface, the steps that include (a) providing a pick-up head having a downwardly opening chamber located proximate the floor surface, the chamber including two upright, resiliently flexible strips extending parallel to one another, (b) providing a spray nozzle connected to said head for movement therewith, (c) providing a carrier and two tanks on the carrier, at least a first of said tanks containing germicidal cleaning solution, (d) applying suction to the chamber interior so that the strip lower edge portions engage the floor surface and flex, bodily displacing the chamber in one direction along the floor surface while continuing to apply suction to said chamber to cause the strip lower edge portions to flex in the opposite direction causing pick-up of soils and bacteria into the chamber and delivering said soils and bacteria into one of said tanks, (e) and delivering germicidal cleaning solution from the other of said tanks to said spray nozzle to spray the solution visibly and openly outside the space between the strips and onto the floor surface from which soils and bacteria have been removed as aforesaid, thereby to wet said surface and bacteria remaining on said surface and (f) bodily displacing the chamber in the opposite direction along the floor surface and over the wetted surface and while suction is applied to said chamber to cause the strip lower edge portions to flex in said one direction causing pick-up of said solution and remanent bacteria on said surface into said chamber, and delivering the solution and remanent bacteria thus picked-up to said one tank to kill said remanent bacteria.

12. The method of claim 11 including the step of moving said head back and forth in said direction to cause said strips to scrub said wetted floor surface.

13. In the method of removing soils and bacteria from a hard floor surface, the steps that include (a) providing two upright, longitudinally spaced, resiliently flexible strips extending generally laterally horizontally and parallel to one another;

(b) applying suction to the space between the strips so that the lower edge portions engage the hard floor surface and flex, (c) applying cleaning liquid to the floor surface outside the space between the strips to wet the surface, and (d) bodily displacing the strips longitudinally in one direction in such proximity to the floor surface while continuing said suction application to an extent that the lower edge portions of the strips flex relatively in the opposite direction and the leading strip in said one direction passes said applied liquid relatively therebeneath into the space between the strips for suction removal from said space, and (e) bodily displacing the strips longitudinally in the opposite direction and in such proximity to the wetted floor surface and while further continuing said suction application to an extent that the lower portions of the strips flex relatively in said one direction and the leading strip in said opposite direction passes said applied liquid relatively therebeneath into the space between the strips for suction removal from said space.

* * * * *